United States Patent [19]

Mayne et al.

[11] 4,423,712

[45] Jan. 3, 1984

[54] ENGINE RETARDER SLAVE PISTON RETURN MECHANISM

[75] Inventors: Harry H. Mayne, Simsbury; Raymond N. Quenneville, Suffield, both of Conn.

[73] Assignee: The Jacobs Mfg. Company, Bloomfield, Conn.

[21] Appl. No.: 372,551

[22] Filed: Apr. 28, 1982

[51] Int. Cl.[3] ..... F02D 31/00

[52] U.S. Cl. ..... 123/321; 123/90.15; 123/198 F

[58] Field of Search ..... 123/320–322, 123/90.12, 90.15, 90.43, 90.45, 90.46, 198 F

[56] References Cited

U.S. PATENT DOCUMENTS

| | | | |
|---|---|---|---|
| 3,220,392 | 11/1965 | Cummins | 123/321 |
| 3,405,699 | 10/1968 | Laas | 123/320 |
| 3,786,792 | 1/1974 | Pelizzoni et al. | 123/90.16 |
| 3,859,970 | 1/1975 | Dreisin | 123/320 |
| 4,033,304 | 7/1977 | Luria | 123/90.12 |
| 4,150,640 | 4/1979 | Egan | 123/90.12 |
| 4,271,796 | 6/1981 | Sickler et al. | 123/321 |
| 4,384,558 | 5/1983 | Johnson | 123/321 |

*Primary Examiner*—William A. Cuchlinski, Jr.
*Attorney, Agent, or Firm*—Donald E. Degling

[57] ABSTRACT

An hydraulic slave piston return mechanism is provided for an engine retarder of the compression relief type. The mechanism senses the position of the slave piston at the time when the engine exhaust valve has been opened. At this point, the hydraulic pressure on the slave piston is equalized by opening a passageway through the slave piston to an accumulator whereupon the engine exhaust valve spring immediately closes the exhaust valve. Thereafter, the accumulator returns the hydraulic fluid to the hydraulic circuit. The mechanism assures that the exhaust valve opened near the end of the compression stroke to produce the desired engine retarding effect is closed prior to the end of the expansion stroke without affecting the retarding horsepower produced by the engine retarder or the normal functioning of the exhaust valve during the exhaust stroke of the engine.

6 Claims, 12 Drawing Figures

ENGINE RETARDER SLAVE PISTON RETURN MECHANISM

BACKGROUND OF THE INVENTION

1. Field of the Invention

This invention relates to engine retarders of the compression relief type. More particularly, the present invention relates to a slave piston travel limiter and return mechanism with an accumulator piston for hydraulic fluid storage which insures that an exhaust valve (or valves) which was opened to produce the desired engine retarding effect is closed prior to the normal opening of the exhaust valve (or valves).

2. The Prior Art

Engine retarders of the compression relief type are well known in the art. Such retarders are designed to convert, temporarily, an internal engine of the spark ignition or compression ignition type into an air compressor so as to develop a retarding horsepower which may be a substantial portion of the operating horsepower normally developed by the engine.

The basic design for an engine retarding system of the type here involved is disclosed in the Cummins U.S. Pat. No. 3,220,392. In that design, an hydraulic system is employed wherein the motion of a master piston actuated by an appropriate intake, exhaust or injector pushrod or rocker arm controls the motion of a slave piston which opens the exhaust valve of the internal combustion engine near the end of the compression stroke whereby the work done in compressing the intake air is not recovered during the expansion or "power" stroke but, instead, is dissipated through the exhaust and cooling systems.

Various improvements have been made in the original design shown in the Cummins U.S. Pat. No. 3,220,392 referred to above. Sickler et al. U.S. Pat. No. 4,271,796 discloses a pressure relief system for a compression relief engine retarder wherein a bi-stable ball relief valve and damping mechanism rapidly drops the pressure in the hydraulic system to a predetermined low level whenever an excess pressure is sensed in the hydraulic system, thereby obviating the risk of damage to various components in the engine valve train mechanisms.

U.S. Pat. application Ser. No. 248,344, assigned to the assignee of the present invention, discloses an improved timing mechanism for an engine retarder which produces an increased retarding power while increasing the time span between the beginning of the normal opening of the exhaust valves of the engine.

Another improvement in engine retarder operation is disclosed in U.S. Pat. application Ser. No. 124,581, assigned to the assignee of the present invention. Application Ser. No. 124,581 relates particularly to engines equipped with dual exhaust valves and an engine retarder of the compression relief type and discloses apparatus to open only one of the dual exhaust valves during retarder operation while permitting both valves to be opened during normal engine operation.

Laas U.S. Pat. No. 3,405,699 discloses a device designed to unload the hydraulic system whenever excess motion of the slave piston tends to open the exhaust valve too far and hence risk damage to the components of the engine. Like the device of the Sickler U.S. Pat. No. 4,271,796 referred to above, the Laas device is essentially a safety device which functions only when an abnormal condition occurs within the engine retarding mechanism. The abnormal condition in the case of Laas is excess slave piston motion while the abnormal condition in the case of Sickler is excess pressure in the engine retarder hydraulic system.

As has been set forth in the patents and applications referred to above, the compression relief engine retarder uses the existing engine valve train and fuel injector mechanisms to operate the exhaust valves. However, in the apparatus of the patents and applications referred to above, the exhaust valve or valves opened by the retarder may still be open when the normal opening of the exhaust valve or valves is timed to commence. In this event, the rocker arm may impact sharply against the crosshead or valve stem and produce a loading condition which is different, and perhaps more severe, than that originally contemplated in the design of the engine. Such a loading condition may be particularly disadvantageous in the case of engines equipped with dual exhaust valves where the retarder is designed to act on only one valve. In this case, the originally designed symmetrical loading of the crosshead and crosshead guide is transmuted into an asymmetrical loading condition whenever one of the exhaust valves is partially open and the second exhaust valve begins to open.

SUMMARY OF THE INVENTION

In accordance with the present invention, applicants have provided a slave piston travel limiter and return mechanism for engine retarders of the compression relief type which is responsive to the motion of the slave piston. The present invention also comprises a method of operating a compression relief engine retarder wherein the motion of the slave piston is sensed by the reset mechanism which thereupon releases the pressure of the hydraulic system so that the slave piston may return almost to its rest position while the master piston is still in its position of maximum travel. In accordance with a further feature of the invention, the hydraulic fluid which actuates the slave piston may be accumulated within the slave cylinder for use during a subsequent portion of the operating cycle.

BRIEF DESCRIPTION OF THE DRAWINGS

Additional advantages of the process and apparatus in accordance with the present invention will become apparent from the following detailed description of the invention and the accompanying drawings in which:

FIG. 2(*b*) is a cross-sectional detail similar to FIG. 2(*a*) showing the position of the travel limiter and slave piston after the lash in the valve train mechanism has been taken up and the travel limiter and slave piston have opened the exhaust valves.

FIG. 2(*c*) is a cross-sectional detail similar to FIGS. 2(*a*) and 2(*b*) showing the position of the travel limiter and slave piston after the travel limiter has been tripped and returned to its rest position, the hydraulic fluid has filled the accumulator, and the exhaust valves have closed and returned the slave piston nearly to its rest position.

FIG. 2(*d*) is a cross-sectional detail similar to FIGS. 2(*a*), 2(*b*), and 2(*c*) but showing, in addition, the master piston and cylinder. In FIG. 2(*d*), the master piston has moved so as to decrease the pressure of the hydraulic fluid and release the hydraulic fluid from the accumulator whereby the accumulator piston and slave piston are returned to the initial position shown in FIG. 2(*a*).

FIG. 2(*e*) is a cross-sectional view similar to FIG. 2(*a*) showing an alternative construction in which the slave piston acts on only one of the dual exhaust valves.

FIG. 4(*a*) is a cross-sectional view similar to FIG. 4 after the travel limiter and slave piston have moved so as to take up the lash in the valve train mechanism.

FIG. 4(*b*) is a cross-sectional view similar to FIGS. 4 and 4(*a*) after the travel limiter and slave piston have moved so as to open the exhaust valve.

FIG. 4(*c*) is a cross-sectional view similar to FIGS. 4, 4(*a*), and 4(*b*) after the travel limiter has tripped, the exhaust valve has closed, and hydraulic fluid has filled the accumulator.

FIG. 4(*d*) is a cross-sectional view similar to FIGS. 4, 4(*a*), 4(*b*), and 4(*c*) after the hydraulic pressure has begun to drop and the accumulator has discharged hydraulic fluid back to the hydraulic system.

DETAILED DESCRIPTION OF THE INVENTION

Figure 1:
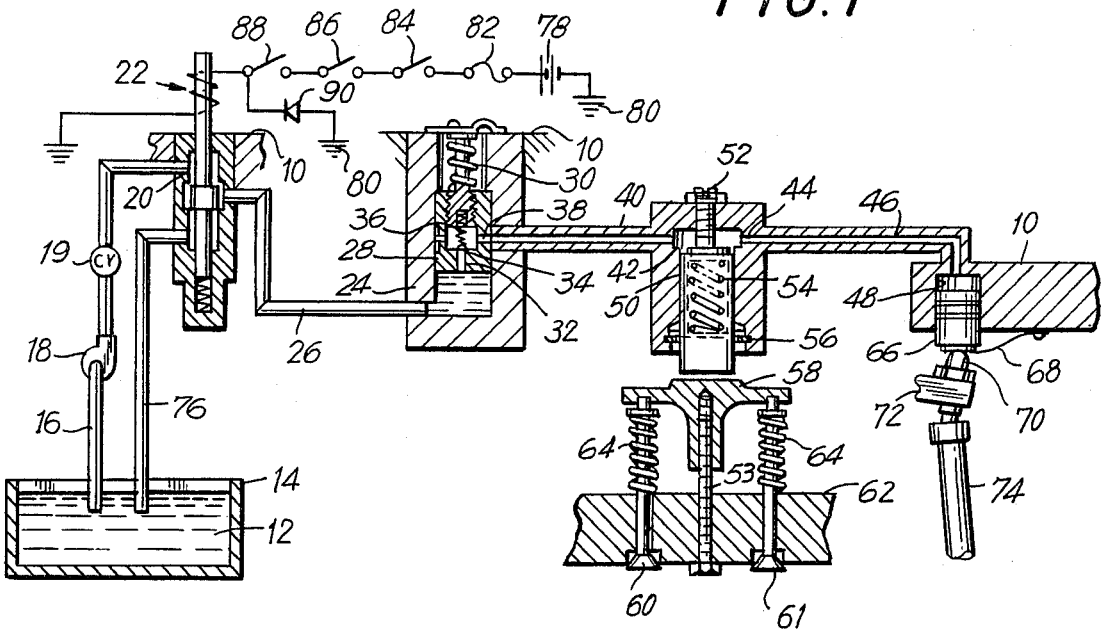
FIG. 1 is a schematic drawing of a compression relief engine retarder incorporating a slave piston travel limiter and return mechanism and an hydraulic fluid accumulator in accordance with the present invention.

FIG. 1 is a schematic diagram of a compression relief engine retarder adapted for use in conjunction with an internal combustion engine of the spark ignition or compression ignition type. As noted above, the basic design of the compression relief engine retarder is disclosed in the Cummins U.S. Pat. No. 3,220,392. For purposes of simplicity and clarity, the present invention will be described with reference to an engine retarder applied to a Cummins compression ignition engine in which the master piston of the engine retarder is driven by the injector pushrod. It will be understood that the invention may also be applied to other engines where, for example, the master piston is driven by an exhaust valve pushrod.

Referring now to FIG. 1, the numeral 10 represents a housing fitted on an internal combustion engine within which the components of the compression relief engine retarder are contained. Oil 12 from a sump 14, which may be, for example, the engine crankcase, is pumped through a duct 16 by a low pressure pump 18 through a check valve 19 to the inlet 20 of a solenoid valve 22 mounted in the housing 10. Low pressure oil 12 is conducted from the solenoid valve 22 to a control cylinder 24 located in the housing 10 by a duct 26. A control valve 28, fitted for reciprocating movement within the control cylinder 24, is urged toward a closed position by a compression spring 30. The control valve 28 contains an inlet passage 32 closed by a ball check valve 34 which is biased into the closed position by a compression spring 36, and an outlet passage 38. When the control valve 28 is in the open position (as shown in FIG. 1), the outlet passage registers with the control cylinder outlet duct 40 which communicates with the inlet of a slave cylinder 42 also formed in the housing 10. It will be understood that low pressure oil 12 passing through the solenoid valve 22 enters the control valve cylinder 24 and raises the control valve 28 to the open position. Thereafter, the ball check valve 34 opens against the bias of the spring 36 to permit the oil 12 to flow into the slave cylinder 42. From the outlet 44 of the slave cylinder 42, the oil 12 flows through a duct 46 into the master cylinder 48 formed in the housing 10.

A slave piston 50 is fitted for reciprocating motion within the slave cylinder 42. The slave piston 50 is biased in an upward direction (as shown in FIG. 1) against an adjustable stop 52 by a compression spring 54 which is mounted within the slave cylinder 42 and acts against a bracket and snap ring 56 seated in the slave cylinder. The lower end of the slave piston 50 acts against a crosshead 58 (or a pin 51 freely journalled within the crosshead, FIGS. 2(*e*) and 4 which, in turn, is fitted for reciprocating motion on a guide pin 53 seated in the engine cylinder head 62. The crosshead 58 engages the stems of exhaust valves 60 and 61. In the event that a pin 51 is employed, then pin 51 engages the stem of valve 60 while the crosshead 58 engages the stem of valve 61. Exhaust valve springs 64 normally bias the exhaust valves 60 and 61 to the closed position as shown in FIG. 1. It will be understood that in normal engine operation a rocker arm (not shown) acts downwardly upon the crosshead 58 so as to open both exhaust valves 60 and 61. However, when the engine retarder is operating, the slave piston 50 acts through sliding pin 51 (if provided) to open only exhaust valve 60 or the slave piston 50 acts directly on the crosshead 58 (if the sliding pin 51 is not provided) to open both exhaust valve 60 and exhaust valve 61. Normally, the adjustable stop 52 is set to provide a clearance of about 0.018 inch (i.e., "lash") between the slave piston 50 and sliding pin 51 (or cross-head 58) when the exhaust valve 60 is closed, the slave piston 50 is seated against the adjustable stop 52, and the engine is cold. This clearance is required and is normally sufficient to accommodate expansion of the parts comprising the exhaust valve train when the engine is hot without opening the exhaust valve 60.

A master piston 66 is fitted for reciprocating movement within the master cylinder 48 and biased in an upward direction (as viewed in FIG. 1) by a light leaf spring 68. The lower end of the master piston 66 contacts an adjusting screw mechanism 70 of a rocker arm 72 controlled by a pushrod 74 driven from the engine camshaft (not shown). As noted above, when applied to the Cummins engine, the rocker arm 72 is conveniently the fuel injector rocker arm and the pushrod 74 is the injector pushrod. In this circumstance, the pushrod 74 and the exhaust valve 60 are associated with the same engine cylinder.

It will be understood that when the solenoid valve 22 is opened, oil 12 will raise the control valve 28 and then fill both the slave cylinder 42 and the master cylinder 48. Reverse flow of oil out of the slave cylinder 42 and master cylinder 48 is prevented by the action of the ball check valve 34. However, once the system is filled with oil, upward movement of the pushrod 74 will drive the master piston 66 upwardly and the hydraulic pressure, in turn, will drive the slave piston 50, downwardly to open exhaust valve 60 and, if no sliding pin 51 is provided, also exhaust valve 61. The valve timing is selected so that the exhaust valve 60 is opened near the end of the compression stroke of the cylinder with which exhaust valve 60 is associated. Thus, the work done by the engine piston in compressing air during the compression stroke is released to the exhaust and cooling systems of the engine and is not recovered during the ensuing expansion stroke of the engine.

When it is desired to deactivate the compression relief retarder, the solenoid 22 is closed whereby the oil 12 in the control valve cylinder 24 passes through the duct 26, the solenoid valve 22, and the return duct 76 to the sump 14. The control valve 28 will then be urged downwardly by the spring 30 and a portion of the oil in the slave cylinder 42 and master cylinder 48 will be vented over the top of the control valve 28 and returned to the sump 14 by duct means (not shown).

The electrical control system for the engine retarder includes the vehicle battery 78 which is grounded at 80. The hot terminal of the battery 78 is connected, in series, to a fuse 82, a dash switch 84, a clutch switch 86, a fuel pump switch 88, the solenoid 22, and, preferably, through a diode 90 back to ground 80. The switches 84, 86, and 88 are provided to assure the safe operation of the system. Switch 84 is a manual control to deactivate the entire system. Switch 86 is an automatic switch connected to the clutch to deactivate the system whenever the clutch is disengaged so as to prevent engine stalling. Switch 88 is a second automatic switch connected to the fuel system to prevent engine fueling when the engine retarder is in operation.

Figure 3:
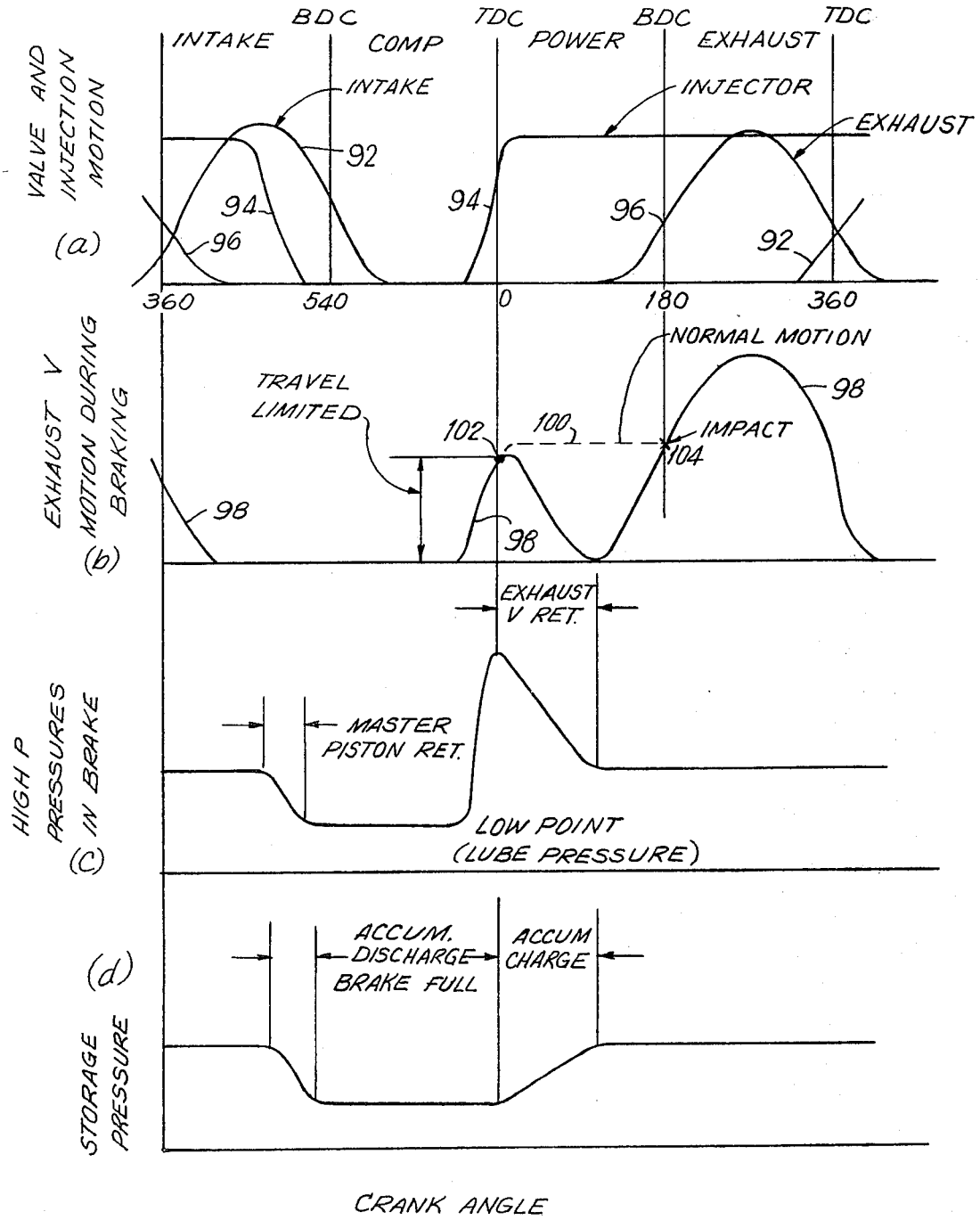
FIG. 3 is a series of charts showing in chart (a) the motion of the exhaust and intake valves and the injector as a function of the crank angle; in chart (b) the motion of the exhaust valve during braking as a function of the crank angle; in chart (c) the pressure in the hydraulic brake circuit as a function of the crank angle; and in chart (d) the pressure in the accumulator as a function of the crank angle.
Figure 4D:
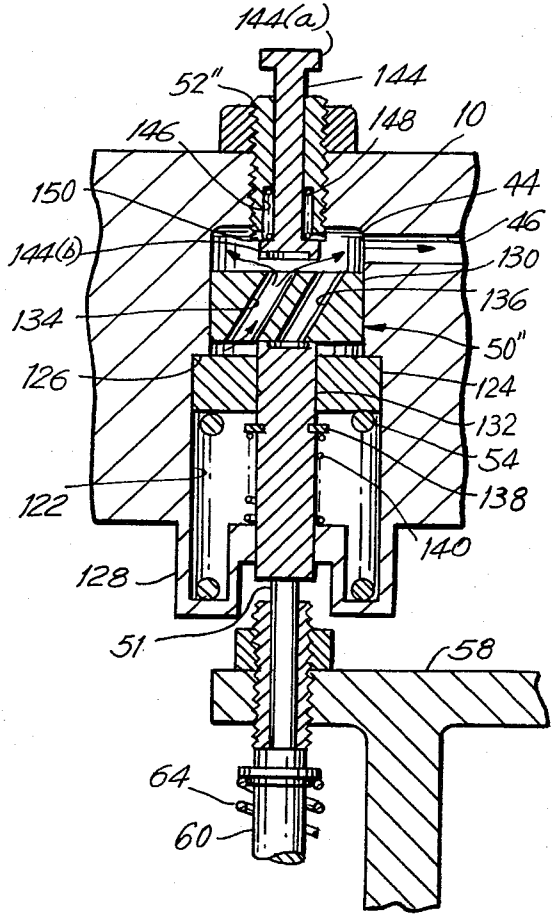
Figure 4C:
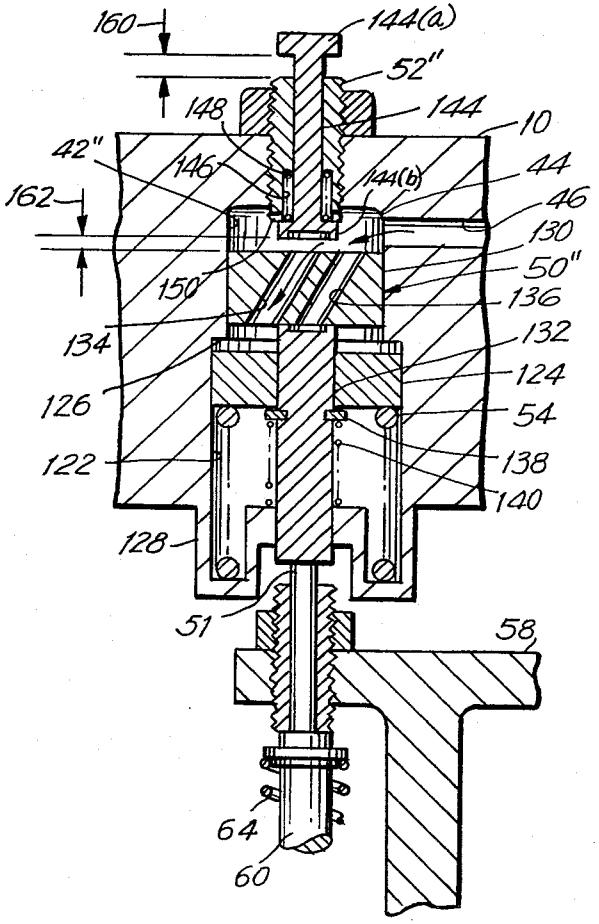
Figure 4B:
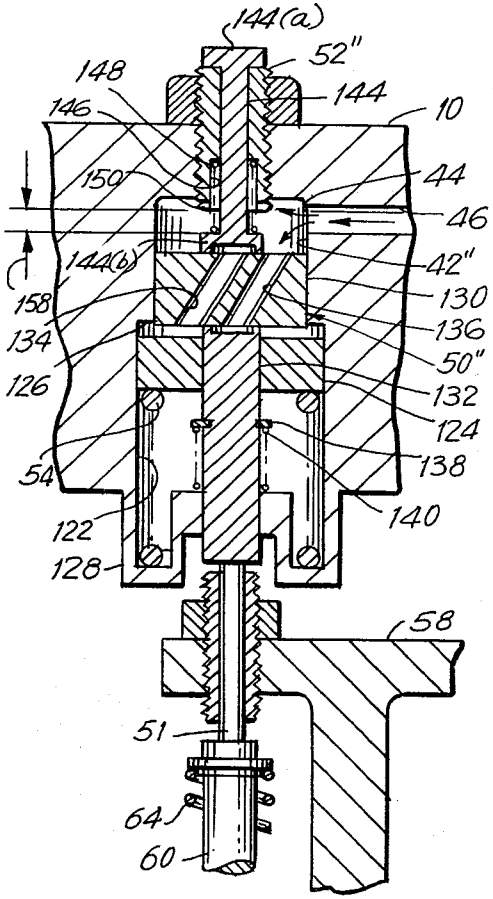

The slave piston travel limiter, reset mechanism, and accumulator according to the present invention may be incorporated into the slave piston 50 and adjustable stop 52. Before describing these mechanisms in detail, it may be helpful to refer to the charts of FIG. 3 so that the operation of the mechanisms will become more apparent. The abscissa of each of the charts in FIG. 3 is the crank angle, and the charts show two full revolutions of the crank for any one cylinder, starting and ending at top dead center (TDC). In Chart (a), curve 92 illustrates the motion of the intake valve, curve 94 illustrates the motion of the fuel injector, and curve 96 illustrates the motion of the exhaust valve. Curves 92, 94, and 96 all show the normal operation of the respective components when the engine is in the fueling mode. It will immediately be apparent that, for this engine, the motion of the injector begins at the end of the compression stroke and thus provides a means to operate the exhaust valve in order to accomplish the desired compression relief function. The apparatus described up to this point does, in fact, utilize the motion of the injector pushrod 74 to open the exhaust valve 60 near the end of the compression stroke.

Turning now to curve (b) of FIG. 3, the curve marked 98 illustrates a desirable motion of the exhaust valve 60 during a braking or retarding mode of operation. Curve 98 shows an initial opening of the exhaust valve near TDC followed by closing prior to the normal opening of the valve. With this motion, the use of the exhaust valve for compression relief braking is seen to have no effect on the normal opening of the exhaust valve. The mechanisms to be described hereafter produce curve 98. The prior art mechanism described above, though producing a compression relief braking result, do not produce an exhaust valve motion following curve 98. Instead, the prior art mechanism follows curve 98 to the point 102 and then, tracking the motion of the injector, follows the dashed curve 100 until the point 104 where curve 100 intersects curve 98, thereafter following curve 98. The abrupt change in slope of the curve at point 104 represents a point of shock loading as the exhaust rocker arm strikes the crosshead 58 (if the compression relief retarder opens both exhaust valves 60 and 61) or an asymmetrical loading (if the compression relief retarder opens only exhaust valve 60). Either condition is undesirable and it is the elimination of these conditions to which the present invention is principally directed.

One embodiment of the present invention is shown in sequential FIGS. 2(*a*)–2(*d*) to which attention is now directed. In FIGS. 2(*a*)–2(*d*), components common to FIG. 1 are given the same identification while modified components are designated by a prime (′). Referring now to FIG. 2(*a*), the slave piston 50′ has been modified to incorporate an internal accumulator piston 106 mounted for reciprocal motion within the slave piston 50′ and a centrally disposed orifice or passageway 108 in the head of the slave piston 50′. It will be appreciated that the compression spring 54 biases the accumulator piston 106 and the slave piston 50′ in an upward direction as viewed in FIG. 2(*a*).

The adjustable stop 52′ has been modified by the addition of a reset valve 110 and a light compression spring 112. The reset valve 110 is in the form of spool having enlarged ends 110(*a*) and 110(*b*). The upper end 110(*a*) of the reset valve 110 reciprocates in a bore 114 formed in the stop 52′ and is biased downwardly by the compression spring 112 interposed between the enlarged end 110(*b*) of the reset valve and the bottom of a bore 116 formed in the lower end of the stop 52′. A transverse or diametral slot 118 is formed in the lower end of the adjustable stop 52′ communicating with the bore 116. The enlarged end 110(*b*) of the reset valve 110 is adapted to seal against the head of the slave piston 50′ and cover the orifice or passageway 108. The reset valve 110 reciprocates with respect to the adjustable stop 52′ a distance equal to the sum of the lash in the valve train and the motion of the slave piston 50′. The lash in the valve train is indicated by the distance 120.

As noted above, FIG. 2(*a*) represents the initial or rest position of the mechanism wherein there is no hydraulic pressure in the system and the slave piston 50′ is held against the end 110(*b*) of the reset valve 110 which, in turn, rests on the adjustable stop 52′ by the action of the compression spring 54. In this condition, it will be apparent that the slave piston 50′ is entirely out of contact with the crosshead 58 and thus can have no effect on the normal operation of the engine. However, as hydraulic pressure builds up in the slave cylinder 42 due to motion of the master piston 66, the slave piston 50′ will move downwardly against the bias of the compression spring 54 to take up the lash 120 in the system and contact the crosshead 58. During this period, the reset valve 110 will remain in sealing contact with the slave piston 50′ due to the hydraulic pressure acting on the upper surface of the end 110(*b*) coupled with the action of the spring 112.

Continued motion of the master piston 66 will drive the slave piston 50′ and the reset valve 110 downwardly, thereby opening the exhaust valves 60 and 61. This action will continue until the position shown in FIG. 2(*b*) obtains. As shown in FIG. 2(*b*), the upper end 110(*a*) of the reset valve 110 has just engaged the bottom of the bore 114 in the adjustable stop 52'. Further motion of the slave piston 50' breaks the seal between the slave piston 50' and the reset valve 110. At this point, the reset valve 110 is rapidly returned to its rest position against the adjustable stop 52' by the action of the high pressure hydraulic fluid on the lower surface of the exposed end 110(*b*) as shown in FIG. 2(*c*). Simultaneously, the hydraulic fluid passes through the exposed orifice 108 in the slave piston 50' and acts against the accumulator piston 106. The slave piston 50' is then driven upwardly by the exhaust valve springs 64, and the exhaust valves 60 and 61 are closed. FIG. 2(*c*) shows the condition of the mechansim following tripping of the reset valve 110. It will be understood that at this point the master piston 66 is still in its position of maximum displacement due to the injector motion, and the hydraulic pressure within the slave cylinder 42 is still relatively high. Due to the lash in the system and the relatively high hydraulic pressure, the slave piston 50' does not seal against the lower end 110(*b*) of the reset valve 110.

Eventually, the master piston 66 begins to move downwardly due to the action of the injector pushrod 74, thereby relieving the hydraulic pressure within the slave cylinder 42. As the hydraulic pressure in the slave cylinder drops, the compression spring 54 drives the accumulator piston 106 upward, returning hydraulic fluid to the slave cylinder 42. When the accumulator piston 106 contacts the head of the slave piston 50', it drives the slave piston 50' upward into sealing engagement with the lower end 110(*b*) of the reset valve 110. This condition is shown in FIG. 2(*d*) and corresponds to the initial rest position of the mechanism as shown in FIG. 2(*a*). The mechanism is now reset and ready for the next cycle of operation. It will be understood that the tripping of the reset valve 110 is caused by the motion of the slave piston 50' and not by the hydraulic pressure in the system so that the slave piston returns almost to its rest position and permits the exhaust valves to close before the hydraulic pressure drops due to a return motion of the master piston 66. A schematic representation of the changes in the hydraulic pressure in the slave cylinder 42 as a function of the crank angle is shown in chart (c) of FIG. 3, while the changes in the hydraulic pressure in the accumulator are shown in chart (d) of FIG. 3.

FIG. 2(*e*) shows an alternative form of the mechanism illustrated in FIGS. 2(*a*)–2(*d*), wherein the slave piston 50' acts against a pin 51 journalled into the crosshead 58. Pin 51, in turn, acts against the stem of exhaust valve 60 to open only that valve during an engine retarding operation. It will be understood that during a normal fueling mode of operation, both exhaust valves 60 and 61 will be opened by the action of a rocker arm (not shown) acting on the crosshead 58. The operation of the mechanism shown in FIG. 2(*e*) is identical to the operation of the mechanism of FIG. 2(*a*) except for the fact that it operates on only one of the dual exhaust valves of the engine.

Figure 4:
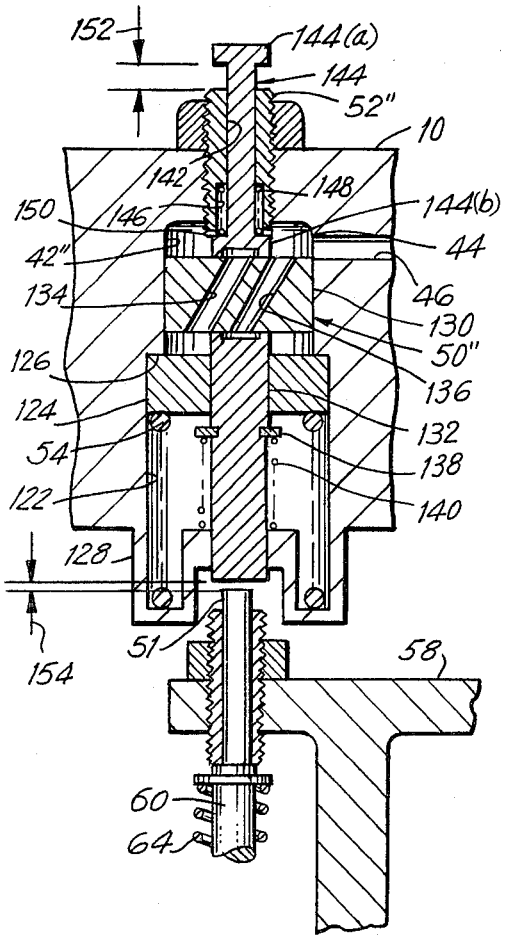
FIG. 4 is an enlarged cross-sectional view of an alternative form of a slave piston and travel limiter and accumulator with the slave piston, travel limiter and accumulator in the rest or initial position.
Figure 4A:
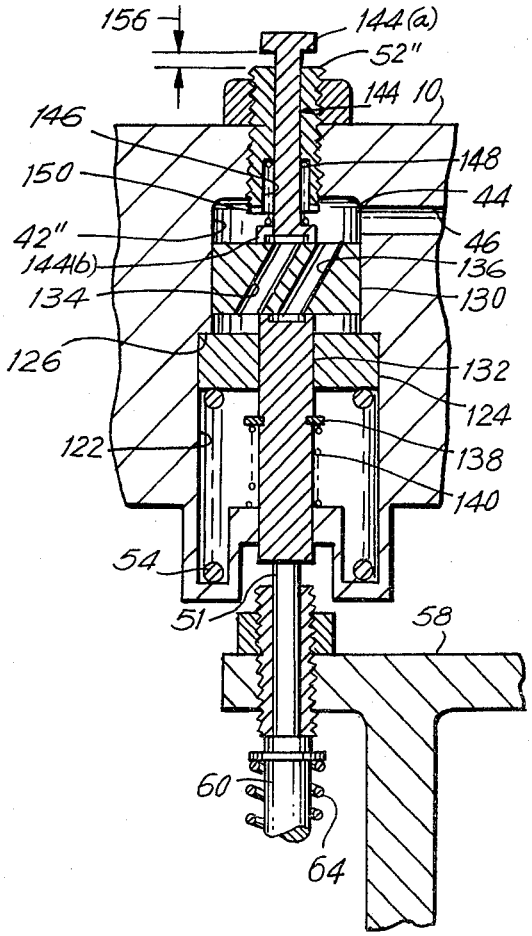
Figure 2C:
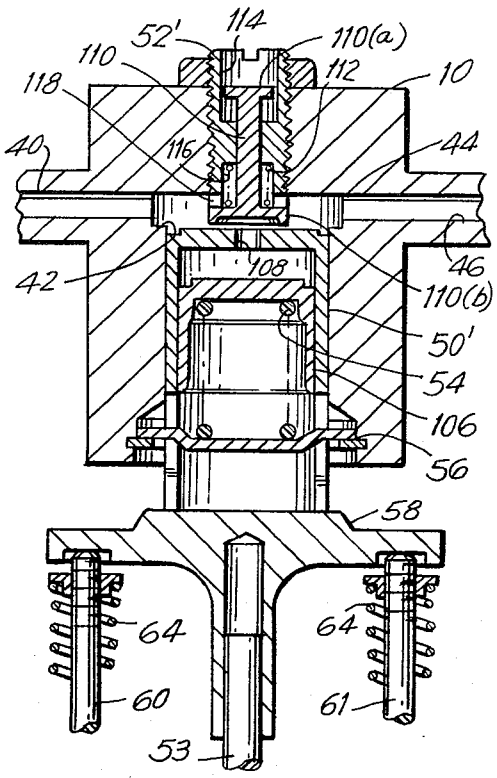
FIG. 2(*a*) is an enlarged cross-sectional detail of the slave piston and cylinder and the associated exhaust valves and crosshead showing the slave piston travel limiter and accumulator with the slave piston and travel limiter in the rest or initial position.
Figure 2B:
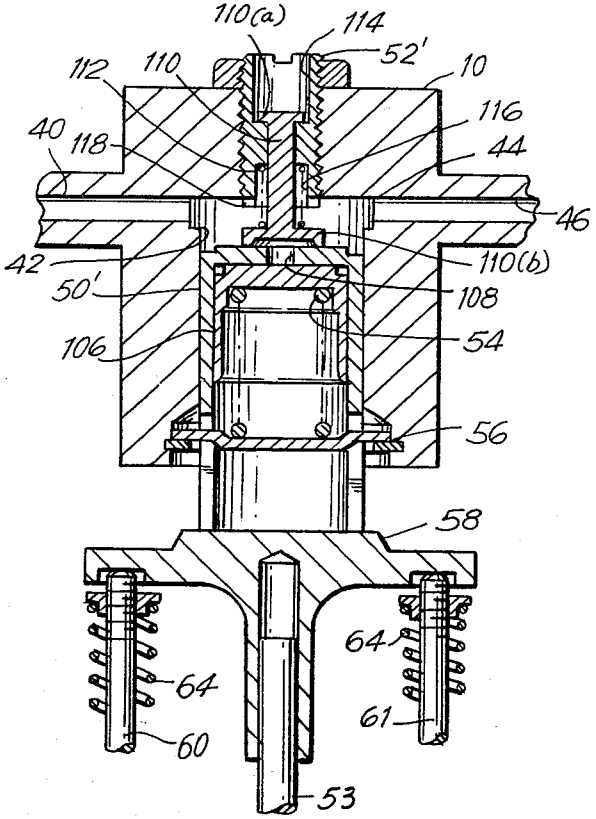
Figure 2A:
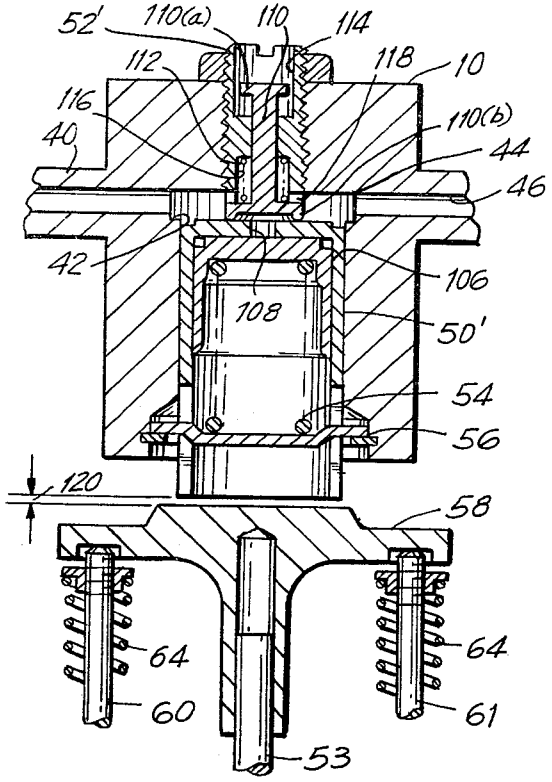
Figure 2E:
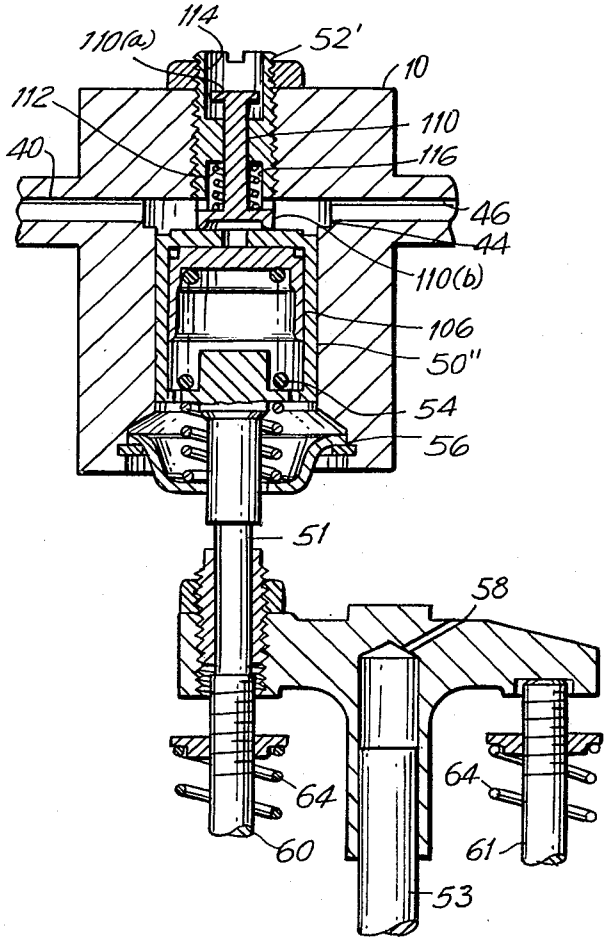
Figure 2D:
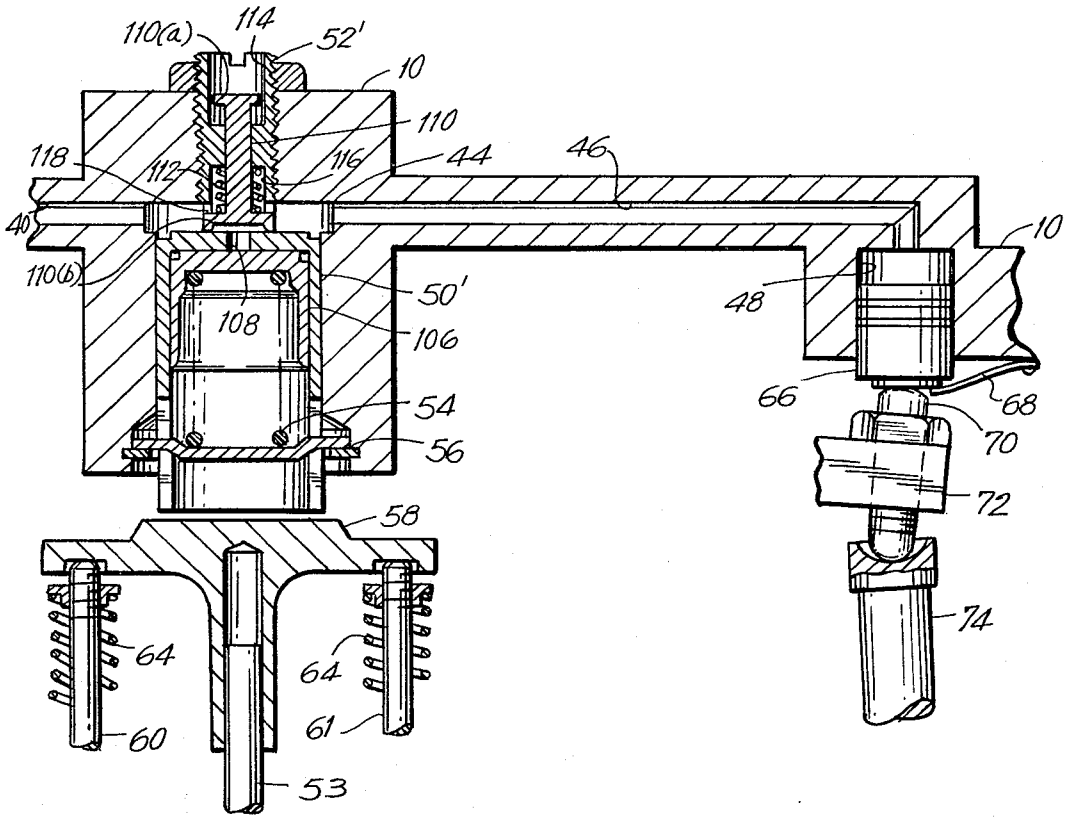

An alternative mechanism for limiting the motion of the slave piston and returning it to a point near its rest position so as to provide prompt closing of the exhaust valves following the compression relief function is shown in FIGS. 4–4(*d*). Components which are common to the mechanism shown in FIG. 1 are designated by the same numerals, while modified components are indicated by a double prime (").

Referring now to FIG. 4, the slave cylinder 42" is provided with a larger bore 122 to accommodate an annular accumulator piston 124 which is biased against the shoulder 126 formed in the slave cylinder 42" by the compression spring 54 which may conveniently be seated in an extension 128 formed in the housing 10. Of course, the spring may also be seated in a bracket-type mounting like that illustrated at 56 in FIGS. 2(*a*) or 2(*e*), if desired.

The slave piston 50" is preferably formed with a head portion 130 which reciprocates within the slave cylinder 42" and a separate rod portion 132 which passes through the annular accumulator piston 124 to engage the upper end of the pin 51 which is freely journalled in the crosshead 58. The lower end of the pin 51 is adapted to engage and drive the stem of exhaust valve 60. The head portion 130 of the slave piston 50" is provided with a first skewed passageway 134 leading from the center of the top of the head 130 to a point in the annular portion of the bottom of the head 130 so as to clear the rod portion 132 of the slave piston 50". A second skewed passageway 136 is formed in the head 130 of the slave piston 50" leading from the center of the bottom of the head 130 to an annular region in the top of the head 130. A snap ring 138 is positioned on the rod portion 132 of the slave piston 50" to provide a seat for one end of a light compression spring 140, the other end of which is seated on the housing extension 128. Spring 140 biases the slave piston 50" in an upward direction as viewed in FIG. 4.

The adjustable stop 52" is provided with a first bore 142 to receive a spool-shaped reset valve 144 having enlarged ends 144(*a*) and 144(*b*) and a second, larger bore 146 adapted to receive a light compression spring 148. Compression spring 148 is seated between the upper end of the bore 146 and the end 144(*b*) of the reset valve to bias the reset valve 144 in a downward direction. Lower end 144(*b*) of the reset valve 144 is adapted to seat against the upper surface of the head 130 of the slave piston 50" and seal the upper end of the passageway 134. A groove or passageway 150 is formed in the lower end of the adjustable stop 52" to provide hydraulic communication between the slave cylinder 42" and the bore 146.

The distance designated by the arrows 152 represents the total stroke of the slave piston 50" including the clearance or "lash" in the mechanism, while the distance designated by the arrows 154 represents the clearance or "lash" alone. It will be understood that when the compression relief retarder is deactivated, the compression spring 140 will raise the slave piston 50" and reset valve 144 to the position shown in FIG. 4, where the slave piston 50" is entirely out of contact with the components of the exhaust valve train.

When the solenoid switch 22 is activated, the hydraulic system is filled with hydraulic fluid at relatively low pressure but sufficient to overcome the bias of the compression spring 140 and thereby take up the clearance or "lash" in the system. This condition is shown in FIG. 4(*a*) where the hydraulic pressure in the slave cylinder 42" has caused the slave piston 50" and the reset valve 144 to move downwardly by the amount of lash preset in the system. The distance designated by the arrows 156 indicates the useful or working motion of the slave piston 50" and also the opening of the exhaust valve 60.

When the master piston 66 (FIG. 1) reaches almost the end of its stroke, the slave piston 50" and the reset valve 144 move downwardly as shown in FIG. 4(*b*)

until the upper end 144(*a*) of the reset valve 144 strikes the upper end of the adjustable stop 52″. At this point, the total travel of the slave piston and reset valve is indicated by the arrows 158, a distance equal to that designated by the arrows 152 in FIG. 4. A slight additional travel of the slave piston 50″ breaks the seal between the slave piston 50″ and the reset valve which trips the reset valve 144 and causes it to be driven upwards to its original rest position as shown in FIG. 4(*c*) and the arrows 160. High pressure hydraulic fluid from the slave cylinder 42″ then passes through the passageway 134 into the region of the slave cylinder 42″ above the accumulator piston 124. With the hydraulic pressure on each side of the head 130 of the slave piston 50″ now equalized, the exhaust valve spring 64 closes the exhaust valve 60 and drives the slave piston 50″ upwardly almost to its rest position. More precisely, the slave piston 50″ comes to rest temporarily at a point below its rest position by the amount of lash preset in the system by the adjustable stop 52″. This is shown by the arrows 162 which indicate a distance equal to the lash in the system.

In order to avoid the possiblity of a premature resealing of the head portion 130 of the slave piston 50″ with the reset valve 144, the second passageway 136 is provided in the head portion 130. It will be appreciated that if the head portion 130 should be moved suddenly toward the reset valve 144, it will separate from the rod portion 132 and thereby open the passageway 136. Passageway 136 thus provides an alternate pathway for the return of hydraulic fluid from the accumulator to the region of the slave cylinder 42″ above the slave piston 50″. Preferably, the passageways 134 and 136 are symmetrically arranged in the head portion 130 of the slave piston 50″ so that the possibility of improper assembly of the head portion 130 is obviated.

Eventually, the master piston 66 begins to return to its original position due to the downward motion of the injector pushrod 74, thus relieving the hydraulic pressure in the slave cylinder 42″. As the hydraulic pressure decays, the accumulator piston 124 under the bias of spring 54 returns hydraulic fluid through passageway 134 or, alternatively, through the passageway 136, to the region of the slave cylinder 42″ above the slave piston 50″. This condition is shown in FIG. 4(*d*). Thereafter, under the combined bias of springs 140 and 148, the reset valve 144 and the slave piston 50″ are brought into sealing abutment and the mechanism is returned to the position illustrated in FIG. 4(*a*) in preparation for the next cycle of operation.

It will be apparent that the structure shown in FIG. 4 may, like the structure of FIG. 2, be adapted to open both exhaust valves 60 and 61 instead of just exhaust valve 60. One way of accomplishing this end would be to locate the slave piston 50″ and slave cylinder 42″ coaxial with the crosshead 58 and extend the rod portion 132 of the slave piston an appropriate amount.

Although, as shown in FIGS. 2 and 4, the sliding pin 51 for single valve actuation is mounted in an adjusting screw mechanism, this is done for convenience only as the adjusting screw mechanism could, alternatively, be associated with the other of the dual exhaust valves.

Consideration of the mode of operation of the structures illustrated in FIGS. 2 and 4 reveals that while both versions are effective to open and close the exhaust valve in the manner indicated generally by curve 98 of FIG. 3, the mechanism of FIG. 2 is designed to move the slave piston away from the crosshead 58 at the end of the cycle as shown in FIG. 2(*d*), while the mechanism of FIG. 4 leaves the slave piston in contact with the crosshead 58 (or pin 51, if used) at the end of the cycle as shown in FIG. 4(*a*). This difference is due to the fact that in the FIG. 4 mechanism, only the relatively light spring 140 urges the slave piston upwardly while in the FIG. 2 mechanism, the much heavier spring 54 acts to bring the slave piston to its final rest position. Thus, the mechanism of FIG. 4 acts to advance the timing of the exhaust valve, thereby shifting curve 98 as shown in FIG. 3 to the left by an amount proportional to the preset "lash" in the system. In general, advancing the timing of the exhaust valve for an injector driven compression relief retarding mechanism increases the retarding horsepower which may be developed.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. In an engine retarding system of a gas compression relief type including an internal combustion engine having exhaust valve means including an exhaust valve spring and pushrod means, hydraulically actuated first piston means associated with said exhaust valve means to open said exhaust valve means at a predetermined time and movable between first and second positions, second piston means actuated by said pushrod means movable between first and second positions and hydraulically interconnected with said first piston means, adjustable stop means axially displaced from said first piston means to define said first position of said first piston means, the improvement comprising an hydraulic return mechanism operable when said first piston means approaches said second position, said hydraulic return mechanism comprising reset valve means mounted in said adjustable stop means for reciprocating motion therewith between first and second positions and adapted to seal against said first piston means, first spring means associated with said adjustable stop means and said reset valve means and biasing said reset valve means toward said first piston means, accumulator piston means located coaxially with respect to said first piston means, second spring means adapted to bias said accumulator toward said first piston means, passageway means formed in said first piston means, said passageway means communicating at one end with said reset valve means and at the opposite end with said accumulator piston means, said reset valve means adapted to seal off said passageway means whenever said reset valve means is in contact with said first piston means to prevent the flow of hydraulic fluid therethrough, the motion of said reset valve means between its first and second positions being less than the motion of said first piston means between its first and second positions whereby when said first piston means approaches its second position said passageway means is opened to permit the flow of hydraulic fluid into said accumulator piston means whereby the hydraulic pressure acting on said first piston means is equalized so as to permit said exhaust valve spring to close said exhaust valve and return said first piston means towards its first position while said second piston means is still in its second position.

2. An apparatus as set forth in claim 1, wherein said accumulator piston is adapted to reciprocate within said first piston means and said second spring means biases said piston means toward said first piston means and said accumulator piston means urges said first piston means toward its first position.

3. An apparatus as set forth in claim 1, wherein said second spring means biases only said accumulator piston means and comprising in addition third spring means biasing said second piston means towards its first position.

4. A process for operating a compression relief engine retarder having an hydraulic pressure circuit comprising applying hydraulic pressure to the hydraulic pressure circuit to drive a piston means from a first toward a second position to open mechanically an engine exhaust valve near the end of the compression stroke of the engine against the bias of the engine exhaust valve spring sensing the position of the piston means when the engine exhaust valve has attained a predetermined open position and the said piston means has approached its second position, equalizing the hydraulic pressure acting on the piston means when the said piston means is at the second position while maintaining an hydraulic pressure in the engine retarder hydraulic pressure circuit, mechanically closing the engine exhaust valve by the bias of the engine exhaust valve spring while maintaining an hydraulic pressure in the engine retarder hydraulic pressure circuit, and thereafter relieving the hydraulic pressure in the hydraulic pressure circuit.

5. A process in accordance with claim 4, wherein upon relief of the hydraulic pressure in the hydraulic pressure circuit, the piston means is maintained at the said first position.

6. A process in accordance with claim 4, wherein upon relief of the hydraulic pressure in the hydraulic pressure circuit, the piston means is maintained at a position intermediate the said first and second positions.

* * * * *